US010054872B2

(12) United States Patent
Ariizumi

(10) Patent No.: US 10,054,872 B2
(45) Date of Patent: Aug. 21, 2018

(54) IMAGE FORMING APPARATUS HAVING REMOVABLE DEVELOPING UNITS

(71) Applicant: CANON KABUSHIKI KAISHA, Tokyo (JP)

(72) Inventor: Osamu Ariizumi, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/440,119

(22) Filed: Feb. 23, 2017

(65) Prior Publication Data

US 2017/0255125 A1 Sep. 7, 2017

(30) Foreign Application Priority Data

Mar. 2, 2016 (JP) ..... 2016-039555

(51) Int. Cl.
*G03G 15/00* (2006.01)
*G03G 15/08* (2006.01)
*G03G 21/16* (2006.01)

(52) U.S. Cl.
CPC ..... *G03G 15/0829* (2013.01); *G03G 15/0889* (2013.01); *G03G 15/0891* (2013.01);
(Continued)

(58) Field of Classification Search
CPC ..... G03G 15/0829; G03G 15/0889; G03G 15/0891
(Continued)

(56) References Cited

U.S. PATENT DOCUMENTS 8,023,839 B2 9/2011 Sakatani et al.
8,315,533 B2 11/2012 Iwanami et al.
(Continued)

FOREIGN PATENT DOCUMENTS

JP 2007-156355 A 6/2007
JP 2009-300645 A 12/2009
(Continued)

OTHER PUBLICATIONS

Osamu Ariizumi et al., U.S. Appl. No. 15/468,342, filed Mar. 24, 2017.
(Continued)

*Primary Examiner* — Quana M Grainger
(74) *Attorney, Agent, or Firm* — Fitzpatrick, Cella, Harper & Scinto

(57) ABSTRACT

An image forming apparatus includes first and second image forming portions. A first conveying pipe conveys a first developer discharged from a first developing unit to a collection portion, and a second conveying pipe conveys a second developer discharged from a second developing unit to the collection portion. A first detection unit detects a toner content of the first developer in the first conveying pipe, and a second detection unit detects a toner content of the second developer in the second conveying pipe. The first developing unit can be removed from the image forming apparatus in a state that the first conveying pipe and the first detection unit remain in the image forming apparatus, and the second developing unit can be removed from the image forming apparatus in a state that the second conveying pipe and the second detection unit remain in the image forming apparatus.

7 Claims, 12 Drawing Sheets

(52) U.S. Cl.
CPC ... *G03G 21/1676* (2013.01); *G03G 2215/083* (2013.01); *G03G 2215/0822* (2013.01); *G03G 2221/1633* (2013.01)

(58) Field of Classification Search
USPC ..... 399/63, 30, 254, 256
See application file for complete search history.

(56) References Cited

U.S. PATENT DOCUMENTS

| | | | | |
|---|---|---|---|---|
| 8,649,708 | B2 | 2/2014 | Watanabe et al. | |
| 9,170,527 | B2 | 10/2015 | Ariizumi | |
| 2011/0052223 | A1* | 3/2011 | Iwanami ..... | G03G 15/0853 399/30 |
| 2012/0177412 | A1* | 7/2012 | Watanabe ..... | G03G 15/0189 399/256 |

FOREIGN PATENT DOCUMENTS

| | | | |
|---|---|---|---|
| JP | 2011-048094 | A | 3/2011 |
| JP | 2012-145744 | A | 8/2012 |
| JP | 2012-159816 | A | 8/2012 |

OTHER PUBLICATIONS

Osamu Ariizumi et al., U.S. Appl. No. 15/460,317, filed Mar. 16, 2017.

* cited by examiner

IMAGE FORMING APPARATUS HAVING REMOVABLE DEVELOPING UNITS

BACKGROUND OF THE INVENTION

Field of the Invention

The present invention relates to an image forming apparatus using an electrophotographic system, such as a laser beam printer, a copying machine, or a facsimile machine.

Description of the Related Art

An image forming apparatus using an electrophotographic system includes a developing device (a developing unit) that allows a developer to adhere to an electrostatic latent image formed on the surface of a photoreceptor (an image bearing member) to develop the electrostatic latent image into a visible image.

Further, the development system of the developing device of the image forming apparatus can be broadly divided into a one-component development system and a two-component development system. Particularly, an image forming apparatus employing a two-component development system, which allows a two-component developer including toner and a carrier to be borne on a rotatable developing sleeve and develops an electrostatic latent image formed on a photoreceptor, is widely used.

In the image forming apparatus employing the two-component development system, only toner included in a developer is consumed with the formation of an image. Accordingly, toner density, which is the ratio of the weight of toner included in the developer, is reduced. For this reason, a toner density sensor, which detects the density of toner included in the developer, is provided and toner is supplied so that toner density is maintained in a predetermined range.

Here, when an image is formed, toner is consumed but a carrier is basically accumulated in the developing device. However, a carrier deteriorates with an increase in the number of sheets on which images are formed, so that the charging performance of the carrier gradually deteriorates. There is a concern that the quality of an image may be caused to deteriorate when the charging performance of the carrier deteriorates.

Accordingly, a structure that suppresses the deterioration of a carrier present in the developing device has been proposed in the past. For example, Japanese Patent Laid-Open No. 2009-300645 discloses a structure that supplies only a carrier or a mixture of a carrier and toner to a developing device and discharges a developer, which is present in the developing device, on one side to exchange the developer. According to this structure, the percentage of the deteriorated carrier included in the developer, which is present in the developing device, is reduced. Accordingly, the deterioration of the quality of an image, which is caused by the deteriorated carrier, can be suppressed.

Here, in the structure disclosed in Japanese Patent Laid-Open No. 2009-300645, a toner density sensor, which detects toner density in the developing device, and a developer amount sensor, which detects the amount of a developer, are provided and the amount of a developer to be supplied to the developing device is determined based on the detection results of these sensors. Since a plurality of sensors is disposed in the developing device as described above and the amount of a developer is detected in addition to toner density, the detection of toner density is hardly affected even though the amount of a developer present in the developing device is changed with, particularly, the supply of a developer.

However, the cost of the developing device is increased in a structure in which sensors are provided in the developing device as in the structure disclosed in Japanese Patent Laid-Open No. 2009-300645. Further, since the control of the toner density sensor needs to be adjusted when the developing device is replaced, a working process needs to be performed at the time of replacement. For this reason, a structure, in which a toner density sensor is disposed in an image forming apparatus even though the developing device is replaced, is preferable. A structure, in which the toner density of a developer discharged from the developing device is detected since the developer discharged from the developing device is relatively similar to a developer present in the developing device, can be employed as a method therefor. However, since the amount of a developer to be discharged is not sufficient, a detection result is likely to be unstable in some cases of the arrangement of the toner density sensor. For this reason, an arrangement in which detection accuracy is improved is desired.

SUMMARY OF THE INVENTION

It is desirable to provide an image forming apparatus that can detect toner density of a developer similar to toner density in a developing device without providing a sensor in the developing device.

A representative configuration of the present invention is an image forming apparatus including:

an image bearing member;

a developing unit which is detachably attached to the image forming apparatus and develops an electrostatic latent image formed on the image bearing member, by using a developer including non-magnetic toner and a magnetic carrier;

a discharge portion which is provided in the developing unit and configured to discharge a developer in the developing unit to the outside of the developing unit;

a collection portion which collects the developer discharged from the discharge portion;

a conveying pipe which is separable from the developing unit, includes a conveying screw therein, and conveys the developer discharged from the discharge portion to the collection portion; and a toner density sensor which detects toner density in the conveying pipe and of which a detection surface is positioned below a rotational axis of the conveying screw in a vertical direction, wherein the developing unit is removed from the image forming apparatus in a state in which the conveying pipe and the toner density sensor remain in the image forming apparatus.

Further features of the present invention will become apparent from the following description of exemplary embodiments with reference to the attached drawings.

DESCRIPTION OF THE EMBODIMENTS

First Embodiment

<Image Forming Apparatus>

First, the entire structure of an image forming apparatus A according to the invention will be described below together with an operation at the time of the formation of an image. The image forming apparatus A of this embodiment is a full-color image forming apparatus using a tandem system that forms an image on a sheet with toner having four colors of yellow Y, magenta M, cyan C, and black K as developers.

Figure 1:
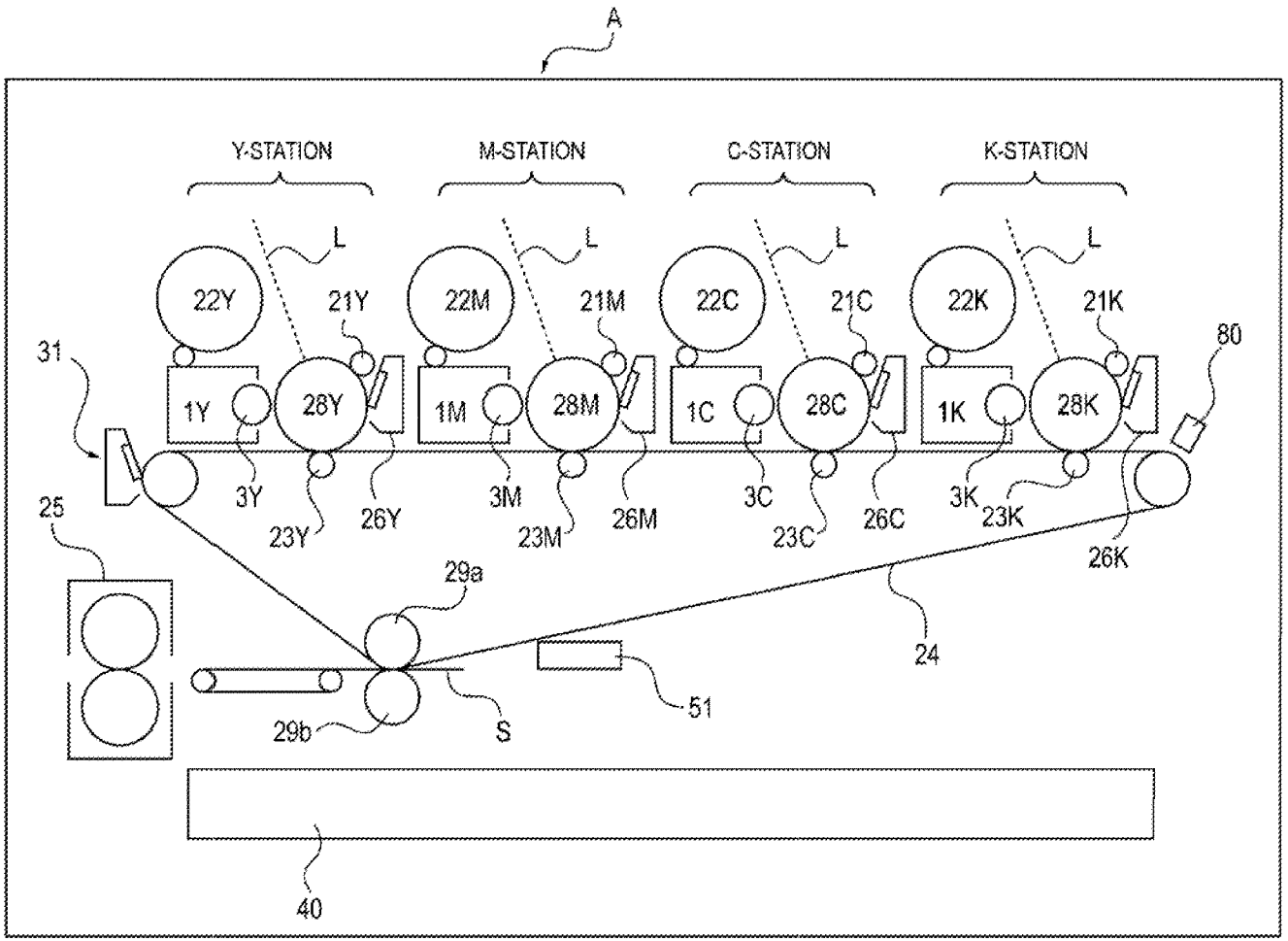
FIG. 1 is a schematic cross-sectional view of an image forming apparatus.

As illustrated in FIG. 1, the image forming apparatus A includes a sheet stacking portion in which sheets are stacked, an image forming portion that transfers a toner image on a sheet, a fixing portion that fixes the toner image to the sheet, and a controller that performs various kinds of control.

The image forming portion includes: photosensitive drums 28 (28Y, 28M, 28C, and 28K) as image bearing members corresponding to yellow, magenta, cyan, and black: and charging rollers 21 (21Y, 21M, 21C, and 21K). Further, the image forming portion includes: developing devices 1 (1Y, 1M, 1C, and 1K) as developing units: drum cleaners 26 (26Y, 26M, 26C, and 26K): and the like. Furthermore, the image forming portion includes: an intermediate transfer unit and a laser scanner unit (not illustrated).

The intermediate transfer unit includes primary transfer rollers 23 (23Y, 23M, 23C, and 23K), an intermediate transfer belt 24, a secondary transfer roller 29*b*, a secondary transfer counter roller 29*a*, a belt cleaner 31, and the like. Further, a temperature/humidity sensor 51 is provided near the secondary transfer roller 29*b*.

Figure 2:
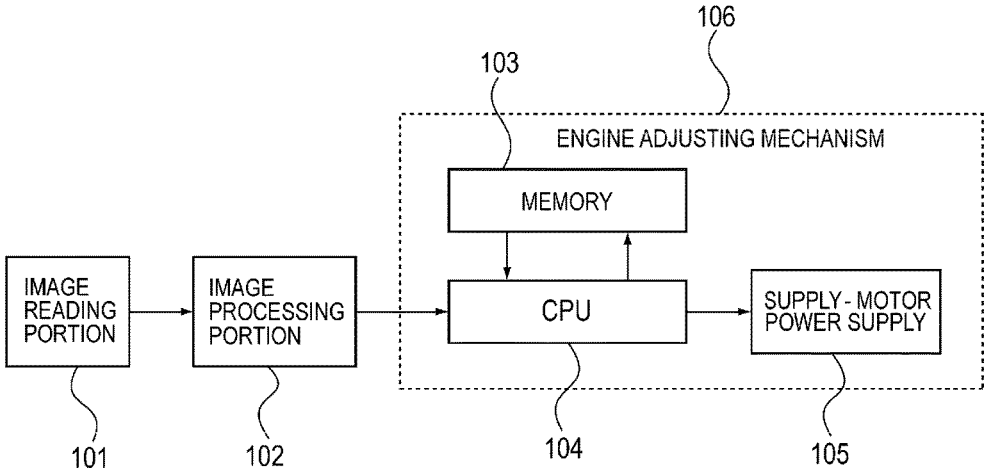
FIG. 2 is a block diagram illustrating the system configuration of the image forming apparatus.

As illustrated in FIG. 2, a memory 103, a supply-motor power supply 105, and an image processing portion 102 are connected to a CPU 104 (the controller) that performs various kinds of control of the image forming apparatus A. Further, an image reading portion 101 is connected to the image processing portion 102.

When the CPU 104 sends an image forming signal at the time of formation of an image, a sheet S, which is stacked and stored in the sheet stacking portion (not illustrated), is sent to the image forming portion along a sheet conveyance path.

Meanwhile, in the image forming portion, first, the surfaces of the photosensitive drums 28 are charged by the charging rollers 21. Further, according to the information about an image, which is read by the image reading portion 101 and is processed by the image processing portion 102, a laser scanner unit (not illustrated) emits laser beams L from a light source provided therein and irradiates the photosensitive drums 28 with the laser beams L. Accordingly, electrostatic latent images corresponding to the information about the image are formed on the photosensitive drums 28.

The electrostatic latent images, which are formed on the photosensitive drums 28, are developed with toner supplied from developing sleeves 3 (3Y, 3M, 3C, and 3K) of the developing devices 1, so that toner images are formed on the photosensitive drums 28. A transfer bias is applied to the primary transfer rollers 23, so that the toner images formed on the photosensitive drums 28 are primarily transferred to the intermediate transfer belt 24.

Next, the primarily transferred toner images reach a secondary transfer portion, which includes the secondary transfer roller 29*b* and the secondary transfer counter roller 29*a*, through the rotation of the intermediate transfer belt 24. Then, the toner images are transferred to a sheet by the secondary transfer portion.

After the sheet to which the toner images have been transferred is sent to a fixing device 25 and is heated and pressurized so that the toner images are fixed to the sheet, the sheet is discharged to the outside of the image forming apparatus A by a discharge roller (not illustrated).

Meanwhile, toner, which remains on the photosensitive drums 28 after primary transfer, is removed by the drum cleaners 26. Further, toner, which remains on the intermediate transfer belt 24 after secondary transfer, is removed by the belt cleaner 31.

<Developing Device>

Next, the developing devices 1 will be described in detail. Each of the developing devices 1 of this embodiment employs a two-component development system, and uses a developer, in which a magnetic carrier and non-magnetic toner having a negative charge polarity are mixed with each other, as a developer.

Meanwhile, non-magnetic toner is a material in which a coloring matter, a wax component, and the like are mixed with a resin, such as a polyester resin or a styrene-acrylic resin, and which is formed in the form of powder by pulverization or polymerization. Further, the magnetic carrier is a material in which a resin is coated on the surface layer of a core which is made of resin particles in which ferrite particles or magnetic powder are kneaded. Further, in the embodiment, toner density, which is the weight ratio of toner included in a developer, is 8% in an initial state.

Figure 3:
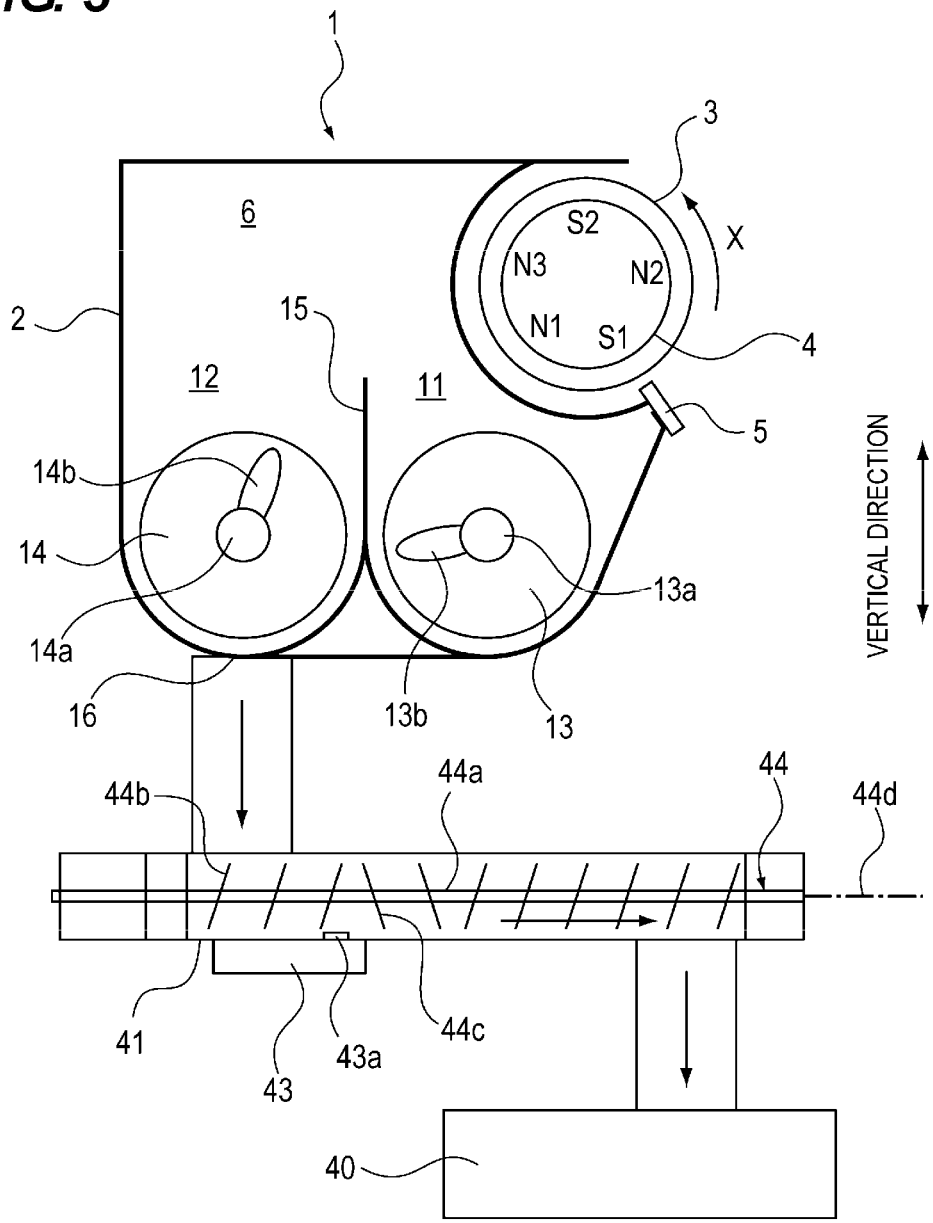
FIG. 3 is a schematic cross-sectional view of a developing device and an image forming apparatus according to a first embodiment.

In the developing device 1, a developer storage portion 6, which stores a developer to be provided for development, is formed by a housing 2 as illustrated in FIG. 3. Further, a partition wall 15 is provided in the developer storage portion 6, and the developer storage portion 6 is partitioned into a development chamber 11 and an agitation chamber 12 by the partition wall 15. Meanwhile, each of the inner diameter of the development chamber 11 and the inner diameter of the agitation chamber 12 is set to φ30 mm in this embodiment.

A region of the development chamber 11, which faces the photosensitive drum 28, is opened, and the developing sleeve 3 as a developer bearing member is rotatably provided in the development chamber 11 so that a part of the developing sleeve 3 is exposed to the opening. The developing sleeve 3 is made of a non-magnetic material, and includes a fixed magnet 4 as a magnetic field-generating portion.

The developing sleeve 3 rotates in the direction of an arrow X during the formation of an image, and conveys a developer, which is attracted at the position of an N1 pole of the magnetic field-generating portion, toward a developing blade 5. Then, the amount of the developer, which is napped by an S1 pole, is regulated by a shearing force applied from the developing blade 5, and a developer layer having a predetermined thickness is formed on the developing sleeve 3.

The developer layer is borne and conveyed to a development region of the developing sleeve 3 facing the photosensitive drum 28, and develops the electrostatic latent image formed on the surface of the photosensitive drum 28, in a state in which a magnetic brush is formed by an N2 pole. The developer, which has been provided for development, is separated from the developing sleeve 3 by a non-magnetic force zone that is present between an N3 pole and the N1 pole.

Figure 4:
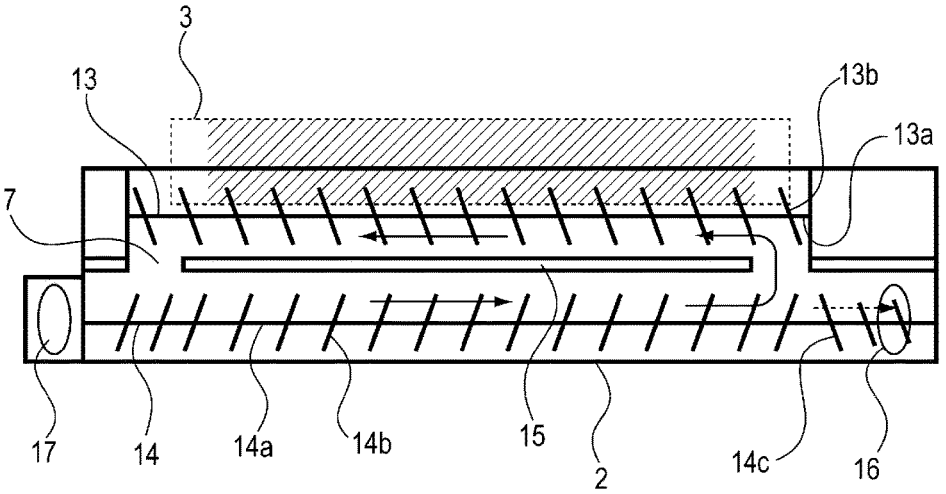
FIG. 4 is a schematic cross-sectional view of the developing device.

Further, as illustrated in FIG. 4, the development chamber 11 and the agitation chamber 12 extend in a longitudinal direction that is the direction of the rotational axis of the developing sleeve 3, and both end portions of the partition wall 15 in the longitudinal direction do not reach the inner walls of the housing 2, so that communication portions 7 are formed. Furthermore, a first conveying screw 13 and a second conveying screw 14, which agitate and convey a developer in the longitudinal direction, are provided in the respective chambers, and the developer is conveyed by these members. Accordingly, the developer circulates in the development chamber 11 and the agitation chamber 12 through the communication portions 7.

Meanwhile, the first conveying screw 13 includes spiral vanes 13*b* that are formed on a rotating shaft 13*a* and convey a developer. Further, the second conveying screw 14 has the same structure as the first conveying screw 13, but some vanes are provided in a direction opposite to vanes 14*b* and serve as reverse vanes 14*c* conveying a developer in a reverse direction. Furthermore, each of the first and second conveying screws 13 and 14 is adapted so that the diameter of a screw shaft is φ8 mm, the diameter of a screw vane is φ20 mm, and an interval between the vanes is 20 mm: and rotates at a speed of 400 rpm.

Further, the developing sleeve 3 and the first and second conveying screws 13 and 14 are adapted to be connected and driven by a gear train (not illustrated), and are rotated by a drive from a developing device-driving gear (not illustrated). Furthermore, the developing device 1 is adapted to be detachably attached to a main body of the image forming apparatus A.

<About the Supply and Discharge of a Developer>

Next, the supply and discharge of a developer in the developing device 1 will be described.

When toner is consumed by an image forming operation, the density of toner included in a developer is reduced. For this reason, a developer for supply, which includes toner and a small amount of a carrier, is supplied to the developer storage portion 6 from a developer supply reservoir 22 (a supply portion) illustrated in FIG. 1 through a developer supply port 17 illustrated in FIG. 4. As illustrated in FIG. 4, the new developer for supply, which has been supplied, circulates in the developer storage portion 6 while being mixed with the developer already present in the developer storage portion 6 and being agitated by the first and second conveying screws 13 and 14. Meanwhile, as the developer for supply, toner and a carrier may be integrally supplied or toner and a carrier may be separately supplied.

Here, toner is consumed with the formation of an image as described above, but the carrier is accumulated in the developing device 1. Further, since a small amount of a carrier is included in the developer for supply, the amount of a developer in the developing device 1 is gradually increased with an operation for supplying a developer for supply. A surplus developer, which cannot circulate along the circulation path of a developer, is generated when the amount of a developer is increased. Accordingly, a developer discharge port 16 as a discharge portion, through which a developer is discharged, is provided on the downstream side of the second conveying screw 14 in a conveying direction, and the surplus developer is discharged from the developer discharge port 16.

As illustrated in FIG. 3, the developer, which is discharged from the developer discharge port 16, is sent to a discharge passage 41 (a conveying pipe) that is provided in the main body of the image forming apparatus A (the main body of the apparatus) and has an inner diameter of φ15 mm. A third conveying screw 44 as a conveying member, which conveys a developer along the discharge passage 41, is disposed in the discharge passage 41, and the developer is collected in a collection container 40 (a collection portion) by the third conveying screw 44.

Meanwhile, as in the case of the first conveying screw 13 or the like, the third conveying screw 44 includes spiral vanes (44*b* and 44*c*) that are formed on a rotating shaft 44*a* and convey a developer. The third conveying screw 44 conveys a developer by rotating. Further, the third conveying screw 44 is adapted so that the diameter of a screw shaft is φ6 mm, the diameter of a screw vane is φ12 mm, and an interval between the vanes is 20 mm: and rotates at a speed of 200 rpm. Meanwhile, a rotational axis 44*d* of the third conveying screw 44 is the center line of the rotating shaft 44*a*.

New toner and a new carrier are supplied as described above and a developer including a carrier, which has deteriorated with time, is discharged instead from the developer discharge port 16, so that a developer stored in the developer storage portion 6 is exchanged. Accordingly, the percentage of a deteriorated carrier in the developer storage portion 6 is reduced and the deterioration of the image quality caused by a charging failure or the like is suppressed.

Figure 5:
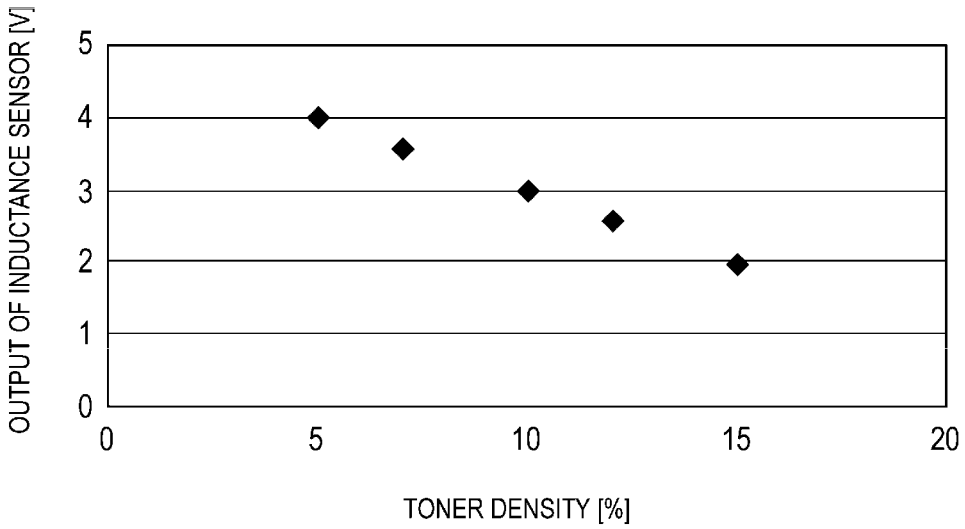
FIG. 5 is a graph illustrating a relationship between the output of an inductance sensor and toner density.

Further, the discharge passage 41 is adapted to be separable from a main body of the developing device 1. Furthermore, the main body of the developing device 1 can be removed from the image forming apparatus A in a state in which the discharge passage 41 remains in the image forming apparatus A. Moreover, an inductance sensor 43 as a toner density sensor, which detects the toner density of a developer, is provided on the bottom of the discharge passage 41. The inductance sensor 43 is a magnetic permeability sensor that detects the magnetic permeability of a developer. That is, as described above, the developer of this embodiment includes a magnetic carrier and non-magnetic toner as main components. For this reason, since magnetic permeability depending on the mixing ratios of a magnetic carrier and non-magnetic toner is changed when the toner density of a developer is changed, the output of the inductance sensor 43 is also changed as illustrated in FIG. 5. Accordingly, a change in the magnetic permeability is detected by the inductance sensor 43, so that the toner density can be detected.

Further, in consideration of the agitation and conveyance of a developer on a detection surface 43*a*, the inductance sensor 43 is disposed so that the detection surface 43*a* protrudes into the discharge passage 41, faces the third conveying screw 44, and is close to the third conveying screw 44. Furthermore, according to the inventors' examination, when a distance between the outermost surface of the third conveying screw 44 and the detection surface 43*a* of the inductance sensor 43 is denoted by G, it is understood that it is preferable that the distance G is set to the range of about 0.2 to 2.5 mm from a relationship of the sensitivity of the sensor. However, when the detection surface 43*a* is too close to the third conveying screw 44, the outermost surface of the third conveying screw 44 comes into contact with the detection surface 43*a* and the detection surface 43*a* is cut. In this case, there is a concern that the detection surface 43*a* may be deformed and chips may be incorporated, and there is a concern that a developer between the detection surface 43*a* and the third conveying screw 44 may be crushed and may form an aggregate and the aggregate may cause an image to deteriorate. In consideration of these examination results, the distance G was set to 0.5 mm in this embodiment. In this embodiment, the detection surface 43*a* of the inductance sensor 43 is positioned below the rotational axis 44*d* of the third conveying screw 44 in the vertical direction. Meanwhile, in the invention, substantially the same detection accuracy as the developer present in the developing device 1 can be obtained when at least 90% of the detection surface is positioned below the rotational axis 44*d* of the third conveying screw 44 in the vertical direction.

Here, since the developer discharged from the developer discharge port 16 is the developer conveyed from the second conveying screw 14 of the agitation chamber, the toner density of the developer discharged from the developer discharge port 16 is substantially the same as the toner density of the developer present in the developer storage portion 6. Accordingly, since the inductance sensor 43 is disposed in the discharge passage 41 and detects the toner density of a developer, it is possible to detect the toner density of the developer, which is present in the developing device 1, from the main body of the image forming apparatus A without providing a toner density sensor in the developing device 1. For this reason, since the manufacturing cost of the developing device 1 can be reduced and the control of a sensor does not need to be adjusted even when the developing device 1 is replaced, workability can be improved.

Further, the amount of the developer, which is to be discharged from the developer discharge port 16, is affected by the amount of the developer that is to be supplied to the developing device 1, that is, an image to be output. For example, since the amount of toner to be used is small when an output image includes many images having a low DUTY, the amount of a developer to be supplied to the developing device 1 is also small and the amount of a developer to be discharged to the discharge passage 41 is also small. However, since a change in a TD ratio of the developer present in the developing device 1 is also small in the case of an image having a low DUTY, the same detection effect as the developer present in the developing device 1 is obtained even though toner density is detected in the discharge passage 41.

On the contrary, since a large amount of a developer is supplied to the developing device 1 when an output image includes many images having a high DUTY, a change in the toner density in the developing device 1 is also increased. However, since the amount of a developer to be discharged to the discharge passage 41 is also increased, toner density can follow a change in the toner density in the developing device 1 even though toner density is detected in the discharge passage 41.

For the above-mentioned reasons, an operation, which changes the characteristics of the discharge of a developer from the developer discharge port 16 according to an output image, are not performed in this embodiment. However, an operation, which adjusts the amount of a developer to be discharged from the developer discharge port 16 according to, for example, the area of an output image or the like, may be performed.

Further, the vanes of the third conveying screw 44 include normal vanes 44*b* (a conveying portion) that convey a developer in the same direction as the conveying direction of the third conveying screw 44, and reverse vanes 44*c* (a reverse conveying portion) that are vanes provided in a direction opposite to normal vanes and temporarily convey a developer in a reverse direction. The conveying direction of the third conveying screw 44, which is mentioned here, is a direction toward the collection container 40 along the discharge passage 41, and the reverse direction is a direction toward the developer discharge port 16. Furthermore, the inductance sensor 43 is disposed near the reverse vanes 44*c*.

Accordingly, first, a developer is temporarily conveyed in a direction toward the developer discharge port 16 by the reverse vanes 44*c*. Accordingly, the developer stagnates near the reverse vanes 44*c*, that is, on the downstream side of the reverse vanes 44*c* (the side of the reverse vanes 44*c* facing the developer discharge port 16) in the conveying direction. Since a dense state in which the degree of the filling of a developer is high is made when the developer stagnates, the toner density of the developer present in the developing device 1 can be more accurately reflected when toner density is detected at a portion where the developer stagnates. Accordingly, since the inductance sensor 43 is disposed near the reverse vanes 44*c*, the accuracy for the detection of toner density can be improved.

Meanwhile, in consideration of the action of the reverse vanes 44*c*, "near the reverse vanes 44*c*" means a stagnation region in which a developer stagnates due to the action of the reverse vanes 44*c*. Further, the stagnation region means a region in which the surface of a developer to be conveyed by the third conveying screw 44 becomes relatively high.

Furthermore, when the amount of a developer stagnating near the reverse vanes 44*c* is increased, the developer goes over the reverse vanes 44*c* and is conveyed toward the collection container 40 by the normal vanes 44*b*. Accordingly, a problem does not occur in the conveyance of a developer.

Meanwhile, the discharge passages 41 corresponding to the respective colors are disposed in the image forming apparatus A, and the toner density of a developer corresponding to each color is detected. Further, the third conveying screws 44 corresponding to the respective colors are adapted to be connected and driven by a gear train (not illustrated), and are rotated at the same time by a drive from a collecting toner motor (not illustrated). However, a motor may be provided for each color, and the third conveying screws may be adapted to be independently driven.

<Sequence Determining the Amount of Toner to be Supplied>

Next, a sequence, which determines the amount of toner to be supplied to the developing device 1 from the developer supply reservoir 22 based on the toner density detected by the inductance sensor 43, will be described with reference to a flow chart illustrated in FIG. 6.

Figure 6:
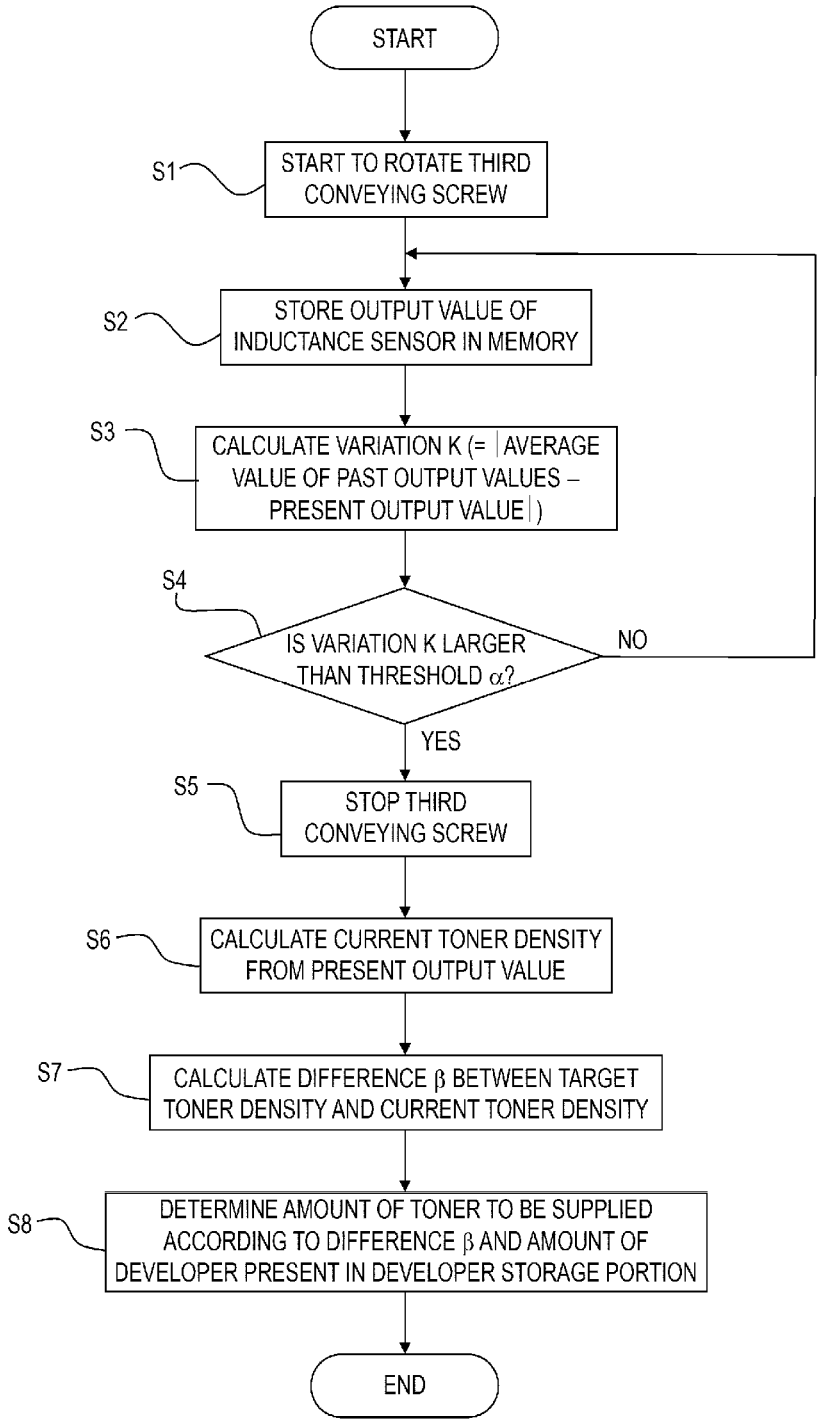
FIG. 6 is a flow chart of a sequence that determines the amount of toner to be supplied.

As illustrated in FIG. 6, when the sequence is started, first, the third conveying screw 44 starts to be rotated by a drive from a collection motor (not illustrated) (S1). Meanwhile, in this embodiment, the collection motor is operated in conjunction with the rotation of the second conveying screw 14.

Next, toner density starts to be detected by the inductance sensor 43 in a state in which the third conveying screw 44 rotates. Here, since the inductance sensor 43 detects magnetic permeability in a predetermined detection range from the detection surface 43*a*, magnetic permeability to be detected changes with the movement of the third conveying screw 44. That is, since a developer passes by the detection surface 43*a* of the inductance sensor according to the rotation period of the third conveying screw 44, the signal waveform of the magnetic permeability detected by the inductance sensor 43 has the maximum value and the minimum value corresponding to the movement of the screw. Accordingly, the inductance sensor 43 detects one rotation of the third conveying screw 44 (time required for one rotation from the rotational speed of the screw) corresponding to an interval between the maximum value and the maximum value of the signal waveform, and calculates an average value of the detected time as an output value, and stores the output value in the memory 103 (S2).

The detection of magnetic permeability is performed every 10 ms in this embodiment. Further, output values are stored in the memory 103 as output values Sig1, Sig2, Sig3, . . . , SigN. Then, when a predetermined number of pieces of data are accumulated, a variation K, which is the absolute value of a difference between an average value of the past output values and the present output value, is calculated based on these data (S3). In this embodiment, an average value of the output values corresponding to the past two seconds is calculated, and a difference Δ between the average value of the past output values and the present output value is calculated as the variation K.

Next, it is determined whether or not the calculated variation K is larger than a threshold α stored in the memory 103 in advance (S4). Here, if the variation K is larger than the threshold α, the state of the surface of a developer present in the developing device 1 is in an unstable state and there is a high possibility that a detection result corresponds to misdetection. Accordingly, returning to Step S2 again, detection is performed by the inductance sensor 43 (S2) and it is determined whether or not the variation K is larger than the threshold α (S3, S4).

On the other hand, if the variation K is equal to or smaller than the threshold α, there is a high possibility that the value detected by the inductance sensor 43 is accurate. Accordingly, the detection of toner density performed by the inductance sensor 43 ends and the third conveying screw is stopped (S5).

Next, the CPU 104 calculates the current toner density from the present output value of the inductance sensor 43 (S6). Since magnetic permeability is changed when the toner density of a developer is changed, the output of the inductance sensor 43 is also changed as described above. Accordingly, toner density can be calculated from the output value of the inductance sensor 43 (see FIG. 5).

Next, a difference β between target toner density, which is stored in the memory 103, and the current toner density is calculated (S7). Meanwhile, in this embodiment, the target toner density is set to toner density (8%) in an initial state. However, the target toner density is not limited thereto, and can be uniquely determined depending on an apparatus to be used, such as the installation environment of the image forming apparatus A. Next, the amount of toner to be supplied is determined based on the difference β and the amount of a developer present in the developer storage portion 6 (S8).

After that, the CPU 104 supplies a developer, which includes toner, to the developing device 1 from the developer supply reservoir 22 according to the amount of toner to be supplied, which is determined by the above-mentioned sequence at the time of the next image forming operation, and the amount of a developer present in the developing device 1.

Second Embodiment

Next, an image forming apparatus A according to a second embodiment of the invention will be described with reference to the drawing. Portions of which description overlaps the description of the first embodiment will be denoted by the same reference numerals as the reference numerals of the first embodiment, and the description thereof will be omitted.

Figure 7:
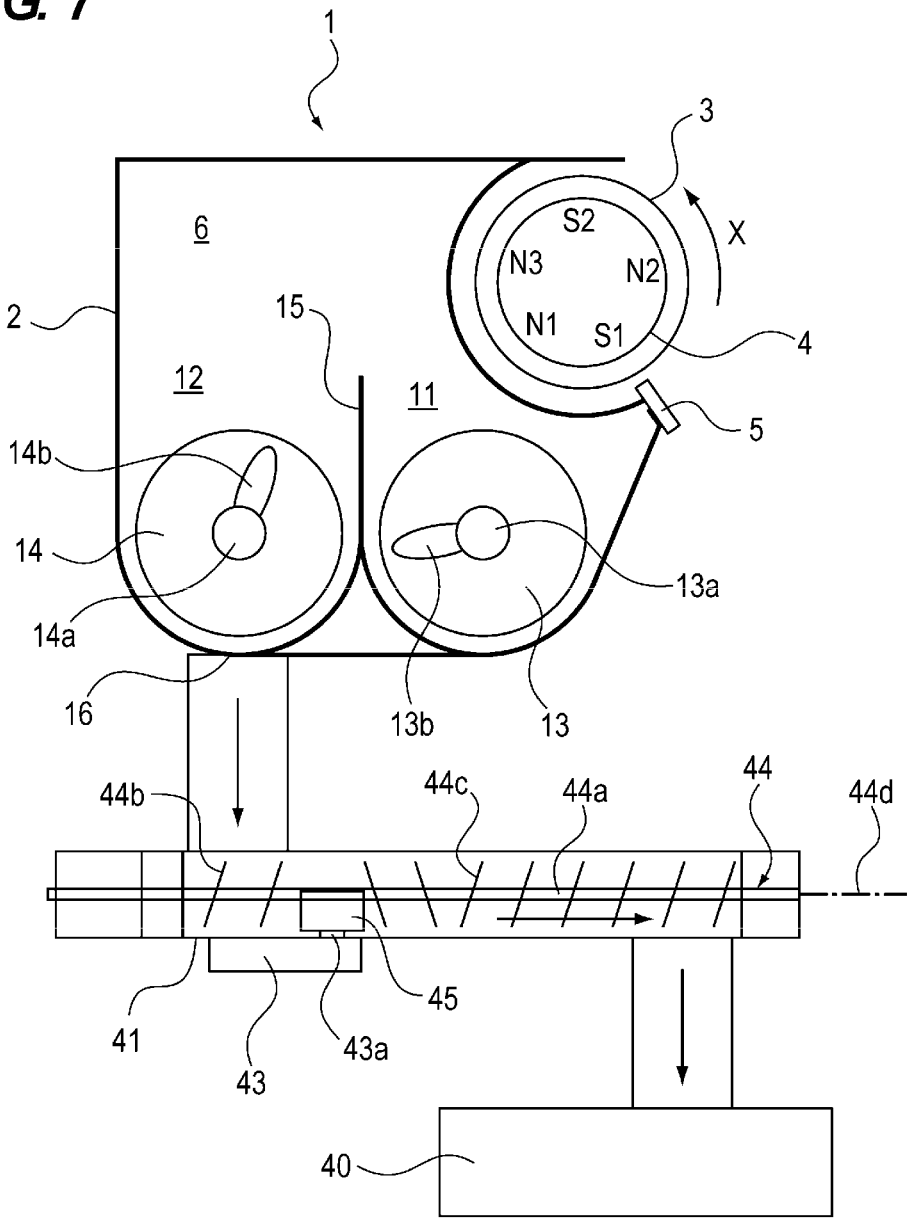
FIG. 7 is a schematic cross-sectional view of a developing device and an image forming apparatus according to a second embodiment.

In the image forming apparatus A according to this embodiment, a rib member 45 as an agitation member, which conveys a developer in the rotational direction of the rotating shaft 44*a* of the third conveying screw 44 and agitates the developer, is provided at a portion facing the detection surface 43*a* of the inductance sensor 43 as illustrated in FIG. 7. Accordingly, since a developer, which stagnates near the detection surface 43*a*, can be agitated, the accuracy of the detection of toner density performed by the inductance sensor 43 can be improved.

Further, in this embodiment, an insulating PET sheet as an elastic member is attached to an end of the rib member 45. In this case, it is preferable that the PET sheet is attached so as to come into contact with the detection surface 43*a* of the inductance sensor 43 during rotation. Accordingly, since the performance of the agitation of a developer performed by the rib member 45 can be improved without damage to the detection surface 43*a*, the accuracy of the detection of toner density performed by the inductance sensor 43 can be further improved. Furthermore, the adhesion of a developer to the detection surface 43*a* of the inductance sensor 43 can be suppressed.

Meanwhile, when this structure is employed in the developer storage portion 6, there is a concern that an aggregate of a developer is formed due to pressure between the PET sheet and the housing 2. However, since the developer of which toner density has been detected is merely collected in the collection container 40 even if an aggregate of a developer is formed under the structure in which toner density is detected in the discharge passage 41, there is no operational problem of the main body.

Third Embodiment

Next, an image forming apparatus A according to a third embodiment of the invention will be described with reference to the drawings. Portions of which description overlaps the description of the first and second embodiments will be denoted by the same reference numerals as the reference numerals of the first and second embodiments, and the description thereof will be omitted.

Figure 8:
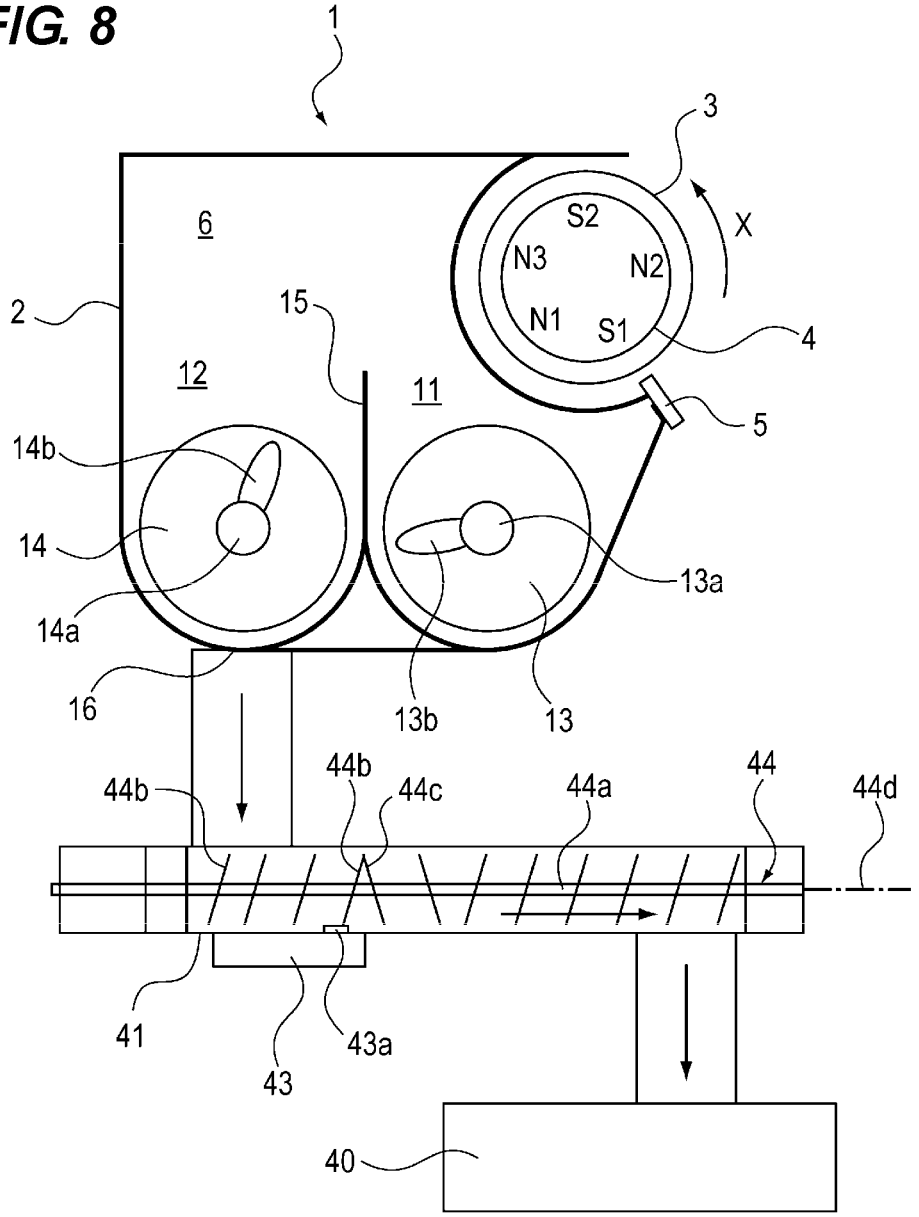
FIG. 8 is a schematic cross-sectional view of a developing device and an image forming apparatus according to a third embodiment.
Figure 9:
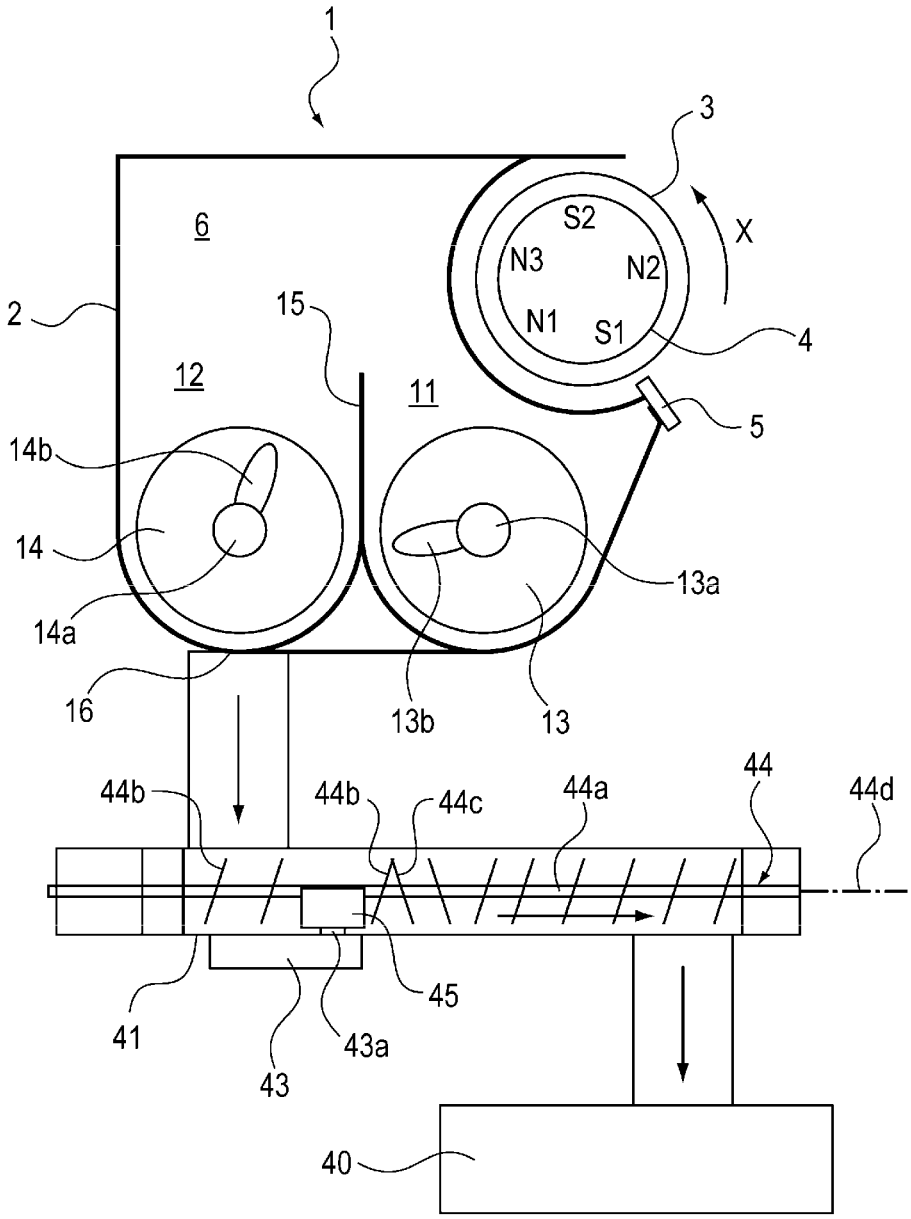
FIG. 9 is a schematic cross-sectional view of the developing device and the image forming apparatus according to the third embodiment.

In the image forming apparatus A according to this embodiment, a part of the normal vane 44*b* and a part of the reverse vane 44*c* are provided on the third conveying screw 44 according to the first and second embodiments so as to be in contact with each other as illustrated in FIGS. 8 and 9.

That is, an end portion of the normal vane 44*b* and an end portion of the reverse vane 44*c* are adapted to overlap each other.

Accordingly, a developer more easily stagnates near the reverse vanes 44*c*. Therefore, since the toner density of the developer present in the developing device 1 can be more accurately reflected when the inductance sensor 43 detects toner density, the accuracy of the detection of toner density can be improved.

Fourth Embodiment

Next, an image forming apparatus A according to a fourth embodiment of the invention will be described with reference to the drawings. Portions of which description overlaps the description of the first to third embodiments will be denoted by the same reference numerals as the reference numerals of the first to third embodiments, and the description thereof will be omitted.

The image forming apparatus A according to this embodiment is adapted to detect toner density and to determine the amount of toner to be supplied, based on the detection result of an image density sensor 80 that detects the density of a black toner image formed on the photosensitive drum 28 in addition to toner density that is detected by the inductance sensor 43.

Figure 10:
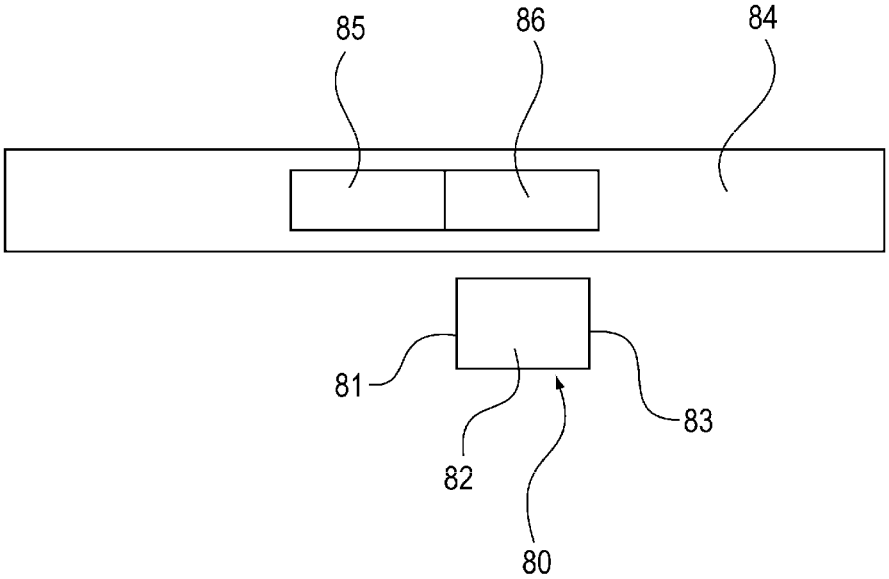
FIG. 10 is a diagram illustrating the structure of the image density sensor.

As illustrated in FIG. 10, the image density sensor 80 includes a LED 81, a light-receiving element 82 for diffused light, and a light-receiving element 83 for regular reflection. Further, a shutter 84 is provided on the front side of the image density sensor 80.

Furthermore, the shutter 84 is one plate-like member, includes a detection window 85 and a protective member 86, and is moved in parallel by a solenoid (not illustrated). Further, when image density is detected, the detection window 85 is moved to the front surface of the image density sensor 80 so that the shutter is opened. When image density is not detected, the protective member 86 is moved to the front surface of the image density sensor 80 so that the shutter is closed. Accordingly, the contamination of the window of the image density sensor 80 is prevented.

Furthermore, for the avoidance of the contamination of the window that is caused by the scattering or dropping of toner from the developing device 1, the image density sensor 80 is provided below a primarily transfer portion at a position facing the intermediate transfer belt 24 as illustrated in FIG. 1.

When image density is detected, a reference toner image pattern having a certain gradation level (96/255 level in this embodiment) determined for the formation of each image is formed outside an image region by a black image forming portion (K-station). Further, the density of a black toner image pattern, which is transferred to the intermediate transfer belt 24, is detected by the image density sensor 80. Meanwhile, in this embodiment, an image forming timing is present until an image forming operation ends after an image within an image region is transferred to the intermediate transfer belt 24.

Figure 11:
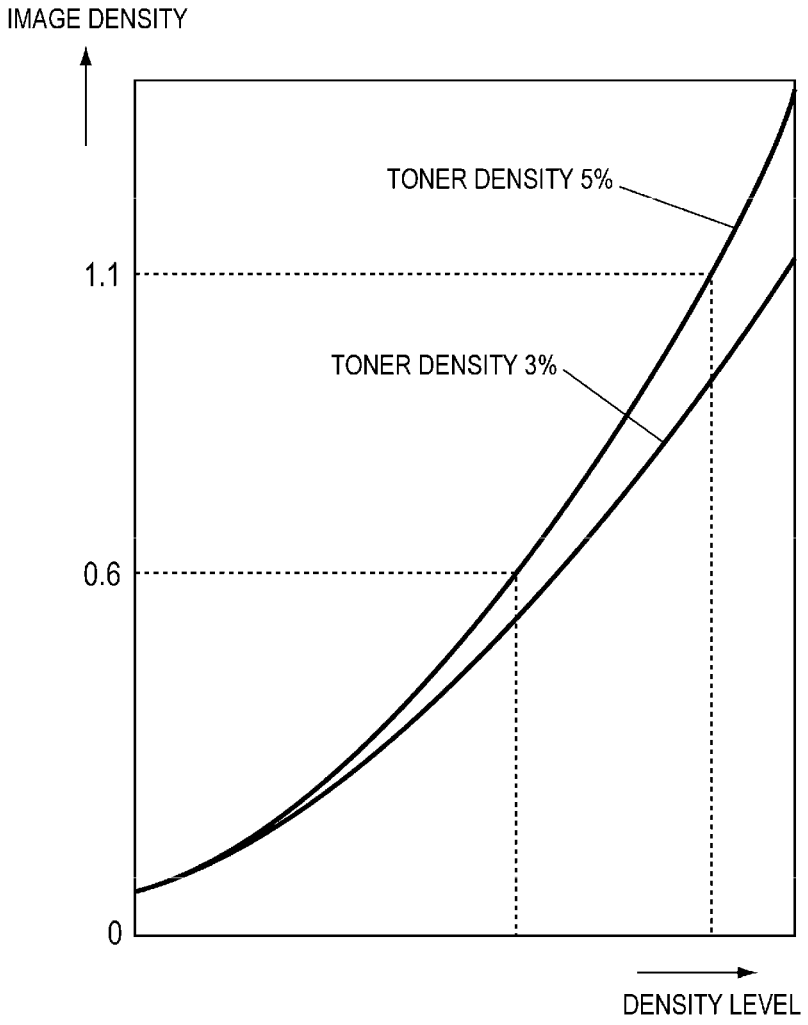
FIG. 11 is a graph illustrating a relationship between the image density of a black toner image and the toner density of a developer that forms the toner image.

FIG. 11 is a graph illustrating a relationship between the image density of a black toner image, which is formed by the image forming apparatus using a two-component development system, and the toner density of a developer that forms a toner image. As illustrated in the graph of FIG. 11, the density of an image becomes high as the toner density of a developer becomes high.

Figure 12:
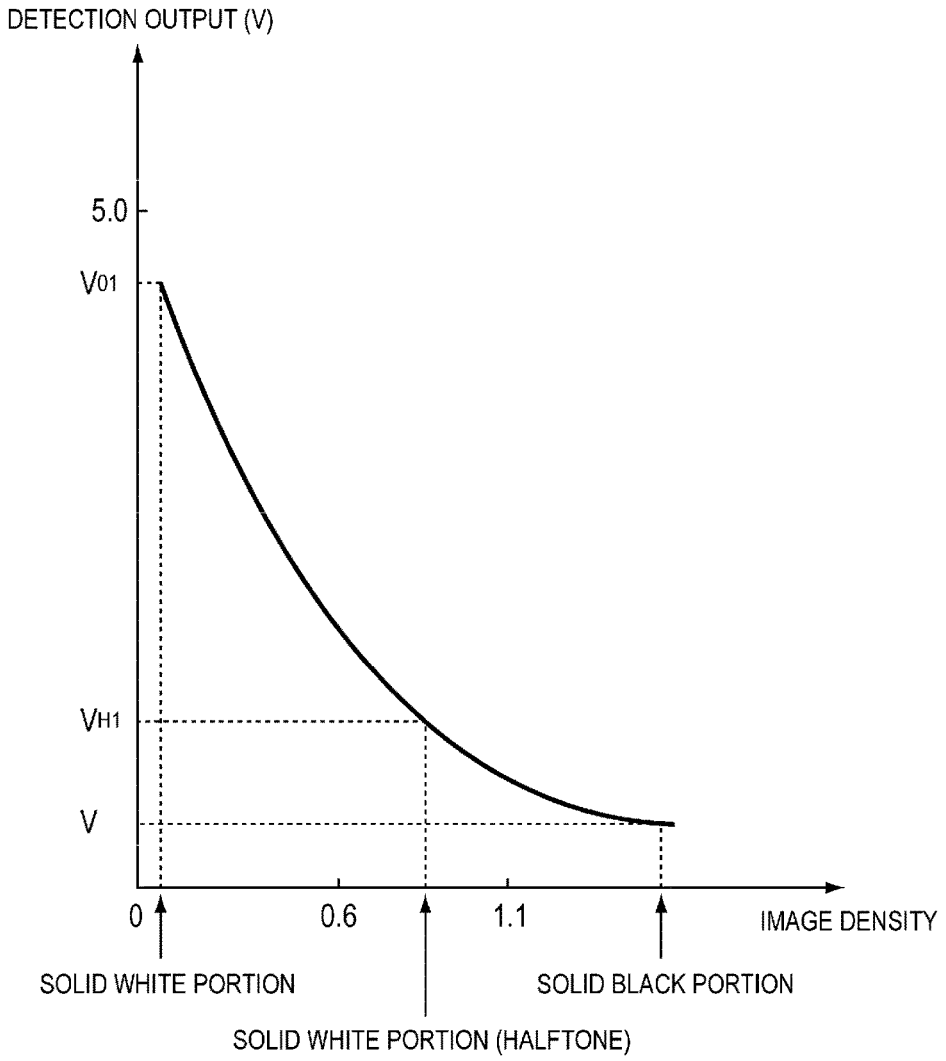
FIG. 12 is a graph illustrating a relationship between the output of an image density sensor and the image density of a black toner image.

Further, FIG. 12 is a graph illustrating a relationship between the output of the image density sensor 80 and the density of a black toner image. As illustrated in the graph of FIG. 12, the density of the black toner image and the output of the image density sensor 80 tend to be inversely proportional to each other.

As the toner density of a developer including black toner is changed, the density of a black toner image is changed and the detection output of the image density sensor is changed as described above. Accordingly, the density of toner included in a developer can be substantially detected from an output value of the image density sensor.

Next, a sequence that determines the amount of black toner to be supplied will be described.

As described above, the density of a black toner image and the output of the image density sensor 80 are inversely proportional to each other as toner is consumed. In this embodiment, an output was changed by about 150 mV when toner density was changed by 1 wt %.

For this reason, in this embodiment, the density of a toner image (patch image) is detected in the initial state of a black developing device 1K first, and a detection output at this time is stored in the memory 103 as a reference level VINIT. Meanwhile, toner density in an initial state is set to 8 wt % in this embodiment.

Next, when toner density is detected, a detection output Vcur of the image density sensor 80 is stored in the memory 103. Further, Vcur and VINIT are compared with each other, and a difference ΔV therebetween (ΔV=VINIT−Vcur) is calculated.

Here, since toner density at the time of the detection of image density is higher than toner density in the initial state when ΔV is larger than 0, toner is not supplied. On the other hand, when ΔV is equal to or smaller than 0, toner density at the time of detection is equal to or lower than toner density in the initial state. Accordingly, the CPU 104 supplies a developer, which includes toner, to the developing device 1K from a developer supply reservoir 22K when the next image is formed.

As the amount of toner to be supplied, a variation ΔD of toner density from the initial state, which is based on ΔV, is calculated first. When a change in an output value relative to a change of 1 wt % in toner density, which has been described above, is referred to as a rate (150 mV in this embodiment), ΔD can be calculated from "ΔD=|ΔV|/rate". Then, the amount of black toner corresponding to the value of ΔD is supplied. For example, when "ΔD=1 wt %" is satisfied under the condition of "ΔV≤0", a developer including toner is supplied so that toner corresponding to 1 wt % can be supplied.

The above-mentioned control is performed at a predetermined interval for the formation of an image on each of, for example, 100 sheets or at the time of the start of the apparatus after the apparatus is left for a long time. Accordingly, since toner density can be further accurately adjusted than a structure in which the inductance sensor 43 detects toner density in the discharge passage 41 alone, an image can be stably output.

Meanwhile, the inductance sensor 43 has been used in the first to fourth embodiments, but the invention is not limited thereto. That is, as long as a structure detecting toner density is provided, toner density may be detected by other methods, such as an optical sensor. Further, a timing where toner density is detected, a period where toner density is detected, the criteria for determination of the state of a developer, a calculation method, and the like are not limited to the above, and can be appropriately adjusted depending on the product concept of the image forming apparatus, the rotational speed and the shape of the conveying screw, and the like.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2016-039555, filed Mar. 2, 2015, which is hereby incorporated by reference herein in its entirety.

What is claimed is:

1. An image forming apparatus comprising:

a first image forming portion having;

a first image bearing member;

a first developing unit detachably attached to the image forming apparatus and developing an electrostatic latent image formed on the first image bearing member by using a first developer including a first toner and a carrier, the first developing unit having a first developing container with a first opening and containing the first developer, a first developer bearing member disposed at the first opening and developing a latent image born on the first image bearing member, a first developer supplying portion supplying the first developer to the first developing container, and a first developer discharging portion configured to discharge a part of the first developer according to supplying of the first developer by the first developer supplying portion, a second image forming portion having;

a second image bearing member;

a second developing unit detachably attached to the image forming apparatus and developing an electrostatic latent image formed on the second image bearing member by using a second developer including a second toner and a carrier, the second developing unit having a second developing container with a second opening and containing the second developer, a second developer bearing member disposed at the second opening and developing a latent image born on the second image bearing member, a second developer supplying portion supplying the second developer to the second developing container, and a second developer discharging portion configured to discharge a part of the second developer according to supplying of the second developer by the second developer supplying portion;

a first conveying pipe detachable from the first developing unit and attached to the first developing unit when the first developing unit is disposed in the image forming apparatus and for conveying the first developer discharged from the first developer discharging portion to a collection portion;

a second conveying pipe detachable from the second developing unit and attached to the second developing unit when the second developing unit is disposed in the image forming apparatus and for conveying the second developer discharged from the second developer discharging portion to the collection portion;

a first detection unit which detects a toner content of the first developer in the first conveying pipe; and a second detection unit which detects a toner content of the second developer in the second conveying pipe, wherein the first developing unit can be removed from the image forming apparatus in a state that the first conveying pipe and the first detection unit remain in the image forming apparatus, and wherein the second developing unit can be removed from the image forming apparatus in a state that the second conveying pipe and the second detection unit remain in the image forming apparatus.

2. The image forming apparatus according to claim 1, further comprising a conveying screw which is disposed in the first conveying pipe, wherein the first detects unit comprises a base portion and a detecting portion disposed on the base portion and detecting toner content of the first developer, wherein the detection portion is disposed at a lower position in a vertical direction than a rotary axis of the conveying screw.

3. The image forming apparatus according to claim 2, wherein the conveying screw comprises a first conveying portion which conveys the first developer in the first conveying pipe in a first direction so that the first developer discharged from the first developer discharging portion is conveyed to the collection portion, and a second conveying portion which conveys the first developer in the first conveying pipe in a second direction opposite to the first direction, wherein the second conveying portion is disposed at a downstream side of the detecting portion in the first direction.

4. The image forming apparatus according to claim 1, further comprising a controller controlling a supplying amount to the first developing container by the first developer supplying portion based on the toner content of the first developer detected by the first detection unit.

5. The image forming apparatus according to claim 4, wherein the controller controls a supplying amount to the second developing container by the second developer supplying portion based on the toner content of the second developer detected by the second detection unit.

6. The image forming apparatus according to claim 4, wherein the first detection unit detects the toner content of the first developer based on inductance of the first developer.

7. The image forming apparatus according to claim 6, wherein the second detection unit detects the toner content of the second developer based on inductance of the second developer.

* * * * *